US005487676A

United States Patent [19]

Maruyama et al.

[11] Patent Number: 5,487,676

[45] Date of Patent: Jan. 30, 1996

[54] SPARK PLUG CAP WITH IGNITION VOLTAGE DETECTIVE CAPACITOR FOR INTERNAL COMBUSTION ENGINE

[75] Inventors: Shigeru Maruyama; Yuichi Shimasaki; Masaki Kanehiro; Takashi Hisaki; Shigeki Baba; Takuji Ishioka; Jiro Takagi; Eitetsu Akiyama, all of Saitama, Japan

[73] Assignee: Honda Giken Kogyo Kabushiki Kaisha, Tokyo, Japan

[21] Appl. No.: 149,378

[22] Filed: Nov. 9, 1993

[30] Foreign Application Priority Data

Nov. 10, 1992 [JP] Japan ..... 4-326167

[51] Int. Cl.[6] ..... F02P 17/00

[52] U.S. Cl. ..... 439/125; 324/402; 324/399

[58] Field of Search ..... 324/399, 402; 439/125–128

[56] References Cited

U.S. PATENT DOCUMENTS 5,317,267 5/1994 Miyata et al. ..... 324/402
5,363,046 11/1994 Shimasaki et al. ..... 324/402
5,391,100 2/1995 Maruyama et al. ..... 324/402
5,419,300 5/1995 Maruyama et al. ..... 123/634

FOREIGN PATENT DOCUMENTS 52-118135 10/1977 Japan .

*Primary Examiner*—Gary F. Paumen
*Attorney, Agent, or Firm*—Nikaido, Marmelstein, Murray & Oram

[57] ABSTRACT

A spark plug cap covering the terminal of a spark plug for an internal combustion engine, made up of an insulative cap body, an ignition coil unit case housing the coil and having a terminal for the ignition coil, a first conductive shaft housed in the insulative cap body for carrying an ignition voltage produced by the ignition coil to the spark plug terminal, and a second conductor located around the first conductor keeping a predetermined distance therefrom separated by the insulative material of the cap body such that a capacitor is formed between the first and second conductors for detecting the ignition voltage. The cap is further provided with a first contact in the form of an annulus provided at the end of said insulative cap body and electrically connected with said second conductor, and a second contact in the shape of a leaf spring electrically connected with the terminal of said case, such that the second contact is brought into contact with the first contact when said case is threaded into said insulative cap body, thereby ensuring electrical connection therebetween.

17 Claims, 6 Drawing Sheets

SPARK PLUG CAP WITH IGNITION VOLTAGE DETECTIVE CAPACITOR FOR INTERNAL COMBUSTION ENGINE

BACKGROUND OF THE INVENTION

1. Field of the Invention

This invention relates to a technology for detecting misfire occurring during operation of a gasoline or other spark-ignition internal combustion engine and more particularly to a spark plug cap with a capacitor for detecting ignition voltage in order to detect such a misfire, and yet more particularly to a spark plug cap having such capacitor and being further provided with an ignition coil which is most suitable for the so-called distributorless ignition system.

2. Description of the Prior Art

As is well known, in gasoline and other types of internal combustion engines a high voltage produced by an ignition coil is distributed to spark plugs at the engine cylinders by an ignition distributor. At each cylinder, the resulting electric discharge between the spark plug electrodes produces a spark which ignites an air-fuel mixture that has been drawn into the cylinder and compressed at the proper time, causing the mixture to burn explosively. In the course of this ignition-combustion process in the internal combustion engine, the mixture may for some reason occasionally fail to burn properly. This is referred to as a misfire. Misfires can result from causes in either the fuel supply system or the ignition system. Misfires caused by problems in the fuel supply system are the result of an overly lean or overly rich air-fuel mixture. At that instance, a spark is produced between the spark plug electrodes but the air-fuel mixture does not ignite. Misfires caused by problems in the ignition systems are the result of spark plug electrodes fouling or ignition circuit malfunctions which prevent normal spark discharge.

The occurrence of misfire in the course of engine operation not only degrades engine performance but may also degrade fuel efficiency. It may further cause after-firing of unburned gases in the exhaust system, which can affect the exhaust emission control system and have other adverse effects. Moreover, since the occurrence of even a single misfire indicates a misadjustment or malfunction in the fuel supply system or ignition system, prompt elimination of the problem is essential. Because of this, there is a strong need for development of a detector for detecting misfires as soon as they occur.

One type of misfire detector that has been proposed is the mis-spark detector described in Japanese Laid-open Patent Publication No. 52(1977)-118135. As shown in FIG. 6, the detector includes a conductor 51 wrapped around a portion of a high-voltage (high tension) cable 50 of the engine ignition system so as to constitute a detective capacitor 52 (a type of capacitance probe) in which the insulation cladding 50A of the high-voltage cable 50 serves as the dielectric. A voltage divider capacitor 53 is connected between the capacitor 52 and the ground so that the ignition voltage (secondary voltage of the ignition coil) applied to the conductive core 50B of the high-voltage cable 50 induces a voltage across the terminals of the capacitor 52 owing to its static capacitance. The induced voltage is statically divided by the capacitor 52 and the capacitor 53, and the voltage across the terminals of the capacitor 53 (the divided voltage) is forwarded as a detection voltage to an electronic circuit 54 for processing and discrimination. The electronic circuit 54 discriminates the occurrence of misfires from the difference between the wave form of the ignition voltage at the time of normal spark discharge and that at the time of no spark discharge (mis-sparking). Among the different types of misfires, the detector thus detects misfires that occur when no spark discharge is produced owing to a problem in the ignition system.

Another detector for detecting misfire in internal combustion engines is disclosed in the present assignee's Japanese Laid-Open Patent Publication No. 5(1993)-65868. In this detector, the ignition voltage is similarly detected from a high-voltage cable or the like of the ignition system using static voltage division, and misfiring owing to causes in the fuel supply system is detected based on the fact that, even when spark discharge occurs, the wave form of the ignition voltage differs between the case where normal combustion occurs and the case where it does not.

In conventional misfire detectors, such a "capacitive probe" is used as a means for detecting ignition voltage. The probe is constituted by wrapping a sheet or ribbon of conductor around the high-voltage cable of the ignition system so as to form a detective capacitor between the conductor and the core of the high-voltage cable using the insulation cladding of the high-voltage cable as the dielectric. However, the capacitance probe constituted in this manner has a major drawback that derives from the nature of the high-voltage cable of the ignition system. Because of its flexibility and elasticity, the high-voltage cable is highly susceptible to vibration. It is also easily affected by changing ambient humidity, wetting by leaking water, and fouling with oil, grime and the like. When a capacitor for use in detection is formed by wrapping a conductor ribbon around the cable, the static capacitance of the capacitor is apt to be changed from its proper value by a shifting of the conductor caused by vibration as well as by changing humidity, wetting with water and fouling with oil, grime and the like. Although some change in static capacitance can be tolerated if the capacitor is to be used only for checking the ignition voltage, even slight changes have to be avoided when it is used for misfire detection, because such detection generally requires accurate detection not only of the ignition voltage but also of the ignition voltage wave form. The capacitance changes to which the prior art capacitance probe is susceptible may alter the detected voltage wave form and thereby make it impossible to detect misfire with high reliability.

In actual practice, moreover, the flexibility and elasticity of the high-voltage cable make the work of attaching the conductor for forming the capacitor on the insulation cladding of the high-voltage cable and securing it thereon difficult and troublesome. Maintenance of the so-formed capacitor is also troublesome.

In addition, the insulation cladding of the high-voltage cable is generally formed of synthetic rubber, a material that is readily degraded when exposed to heat and/or fouled with oil and grime. This degradation of the insulation cladding after the detection capacitor has been formed by winding the conductor around the high-voltage cable not only produces a progressive change in the static capacitance of the capacitor over time, but may also reduce the electric insulation property of the cladding to the point that the high ignition voltage can leak to the conductor wrapped around it. When this happens, the high leak voltage is apt to be conducted to the electronic circuitry of the misfire detector, which it can damage or cause to malfunction. Ideally, moreover, for enabling accurate detection of the ignition voltage wave form, the distance between the conductor and the conductive core constituting the opposite sides of the detective capacitor should be made as small as possible so as to increase its static capacitance. In actuality, however, the conductor and the cable conductive core have to be spaced at a greater distance than desirable as a precaution against loss of the insulation property in the cable cladding owing to the aforesaid causes as well as to corona discharge. As a result, it has been impossible to avoid low accuracy in detecting the ignition voltage wave form.

In order to solve the problems, the present assignee proposed a spark plug cap with voltage detective capacitor for an internal combustion engine, in which a conductor for forming the ignition voltage detective capacitor is provided in a spark plug's cap, all within in the secondary ignition circuit (Japanese Patent Application No. 4(1992)-56395; also U.S. Pat. No. 5,363,046 issued Nov. 8, 1995. More specifically, in a spark plug cap covering the terminal of a spark plug and having a conductor for carrying ignition voltage current from the ignition coil to the spark plug terminal to generate an electronic spark between spark plug electrodes and having an insulator surrounding this conductor, a second conductor is disposed in the insulator around the first conductor maintaining a predetermined distance therefrom so as to form a detective capacitor between the first and the second conductors.

With this arrangement, since the spark plug cap is fixed on the spark plug so as to cover its terminal portion and the spark plug itself is screwed firmly into the head of the internal combustion engine and since the conductor for detection is formed integrally with the spark plug cap insulator, the thus-formed detective capacitor is not only improved in its structure and hence in its service life, but in addition any vibration it does receive will neither shift its position nor deform it. In addition, since the secondary conductor is located inside the spark plug cap, the detective capacitor is isolated from changes in humidity and other ambient conditions and is also protected from the invasion of oil, grime and the like from the outside. As a result, the ignition voltage wave form can always be accurately detected, thereby ensuring accurate discrimination of misfire occurrence. Furthermore, since the conductor is disposed integrally in the cap's insulator at the time of molding it, this eliminates the tedious attaching work and the troublesome maintenance required before.

Aside from the issues raised above, the last several years have seen increasing use of the so-called distributorless or direct ignition system, in which each spark plug is provided with its own ignition coil, from which it receives secondary ignition voltage directly. In this system, the ignition coil is often attached integrally to the spark plug cap at its top. And in such a spark plug cap with the ignition coil, the cap's insulator body for surrounding the conductor carrying high voltage current to the spark plug is usually mold-formed from a material of hard and rigid resin. Since the detective conductor can be provided in the hard and rigid insulator body such that it is firmly secured in position, and therefore ensures accurate detection of the ignition voltage, a spark plug cap of this kind is most suitable as a housing for the voltage detective capacitor under discussion.

When introducing the detective capacitance under discussion to such a spark plug cap as houses an ignition coil, however, a difficulty arises in actually manufacturing the same. More specifically, the detective conductor constituting the ignition voltage detective capacitor should have conductors such as wires or cables for extracting the detected voltage to the exterior and forwarding it to a signal processing circuit or the like. In most vehicles, the place where the spark plug cap is positioned is so narrow that it is often difficult to locate conductors including those for the detective conductor. Since use of the spark plug cap under discussion would increase the number of detectors or cords over the number used with an ordinary cap, assembling such a spark plug cap in a predetermined location becomes more tedious and time-consuming, thereby decreasing working efficiency.

SUMMARY OF THE INVENTION

Therefore, an object of the invention is to provide a spark plug cap with a capacitor for detecting ignition voltage for an internal combustion engine, which endeavors to decrease the number of detectors such as wires or the like to be drawn out to the exterior, whereby enabling to solve the difficulties in assembly.

For realizing the object, the present invention provides a spark plug cap covering the terminal of a spark plug for an internal combustion engine, including, an insulative cap body, a case for housing an ignition coil to be attached to the insulative cap body and having a terminal for the ignition coil, a first conductor housed in the insulative cap body for carrying an ignition voltage produced by the ignition coil to the spark plug terminal; and a second conductor located around the first conductor keeping a predetermined distance therefrom while sandwiching an insulative material such that a capacitor is formed between the first and second conductors for detecting the ignition voltage, wherein the improvement comprises, a first contact provided at the end of said insulative cap body and electrically connected with said second conductor, and a second contact electrically connected with the terminal of said case such that the second contact is brought into contact with the first contact when said case is attached to said insulative cap body.

BRIEF DESCRIPTION OF THE DRAWINGS

These and other objects and advantages of the invention will be more apparent from the following description and drawings, in which.

DETAILED DESCRIPTION OF THE PREFERRED EMBODIMENTS

Figure 1:
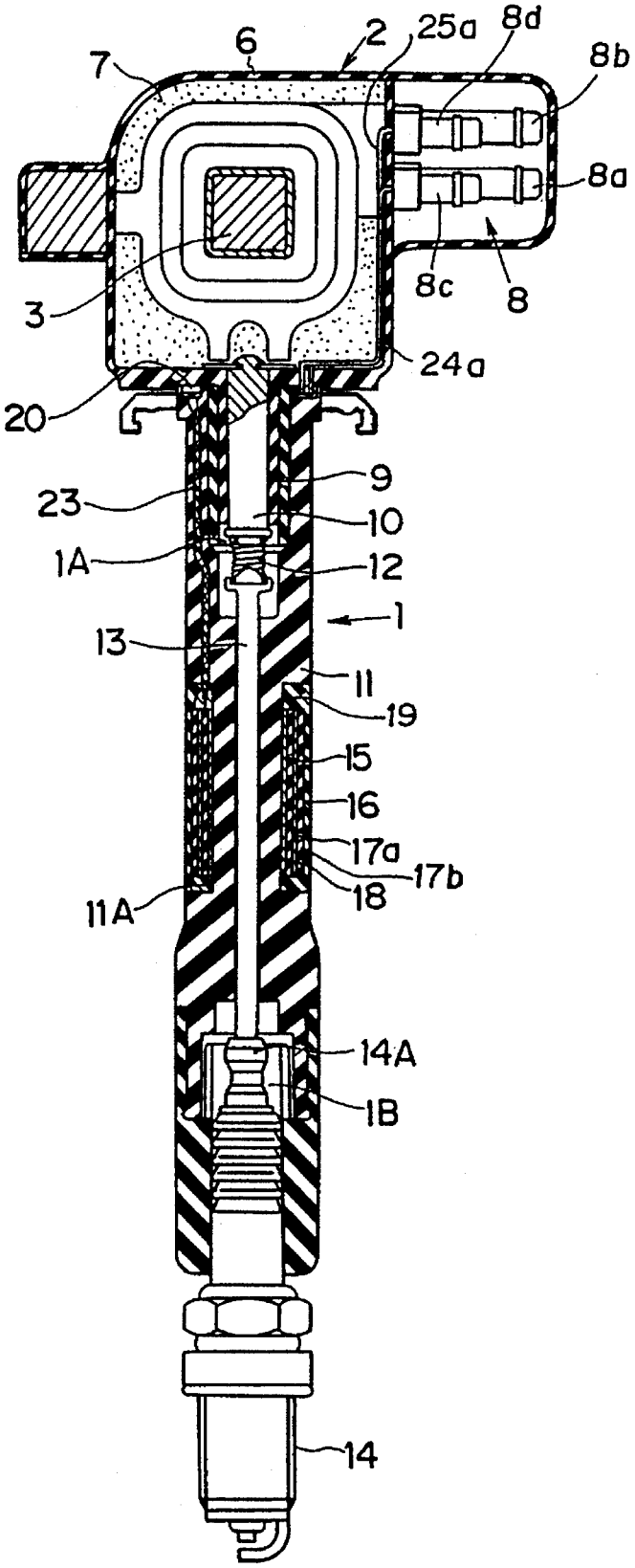
FIG. 1 is a cross sectional front view of a spark plug cap with ignition voltage detective capacitor for an internal combustion engine according to a first embodiment of the invention.
Figure 2:
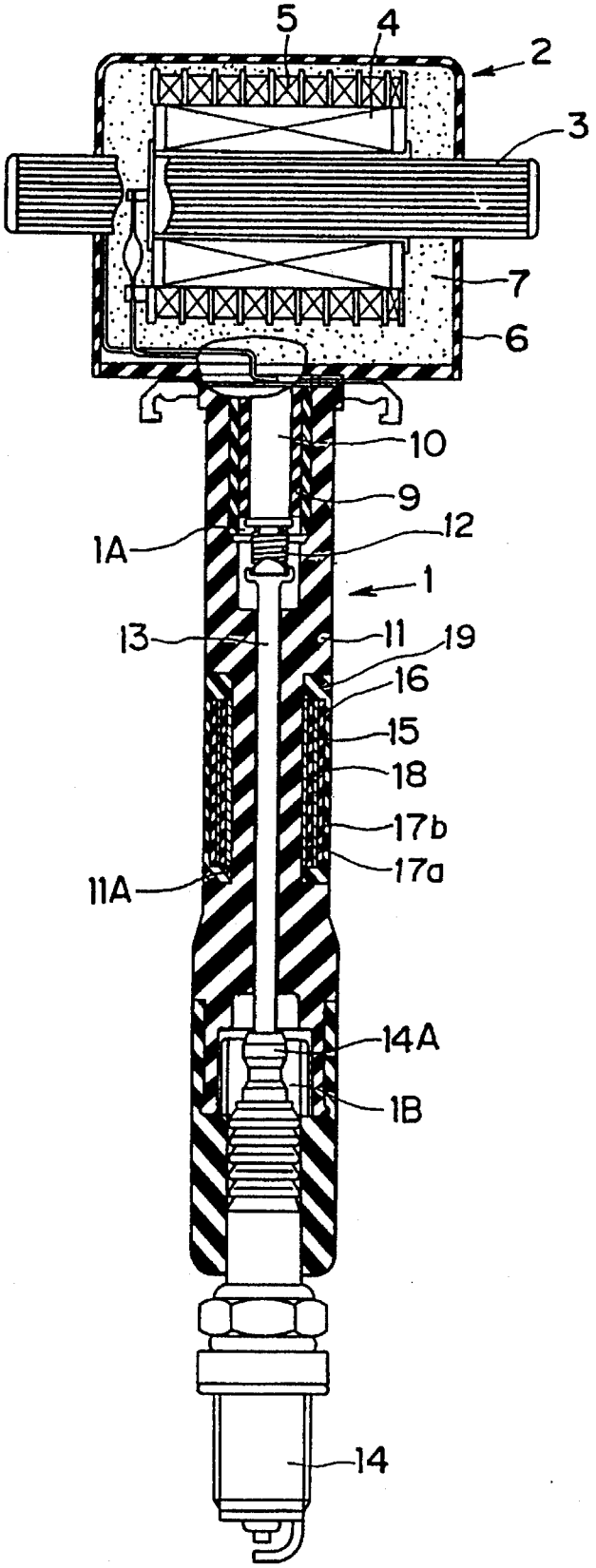
FIG. 2 is a cross sectional side view of the spark plug cap illustrated in FIG. 1.

In FIGS. 1 to 5, a spark plug cap 1 with an ignition voltage detective capacitor according to the invention is shown. The spark plug cap 1 disclosed has an ignition coil unit 2 attached thereto in a manner explained below. The figures illustrate the finished condition at which the spark plug cap is attached with the ignition coil unit 2.

The ignition coil unit 2 has a metallic core 3, around which a primary coil 4 is wound. Around the outside of this primary coil 4 a secondary coil 5 is then wound. The core 3, thus wound by coils 4, 5, is housed in a case 6 made of a hard and rigid resin such as polybutylene terephtalate (PBT), which is filled with an insulative resin 7 such as epoxy resin through injection molding. The case 6 is provided at its side with terminal section 8 for receiving terminals 8*a*, 8*b* for supplying the primary current to the primary coil 4. Additionally the case 6 is provided at its bottom with a cylindrical projection 9 which is formed integrally therewith and projects downwardly. The cylindrical projection 9 is formed with a threaded outer surface and houses therein a shaft 10 made of a conductive material. The conductive shaft 10 is electrically connected to the output terminal of the secondary coil 5.

The spark plug cap 1 is integrally formed in the overall shape of a hollow cylinder from polybutylene terephthalate (PBT) or other hard or rigid resin that exhibits excellent heat resistance and electrical insulation properties. The integrally formed hard resin constitutes an insulator body 11 of the cap. The upper part of the hollow portion centered on the longitudinal axis of the spark plug cap 1 constitutes an upper insertion chamber 1A into which the aforesaid cylindrical projection 9 of the ignition coil unit case 6 is inserted. Specifically, the inner wall of the upper insertion chamber 1A is threaded as a "female screw" to be mated with the "male screw" formed by the external threading on the cylindrical projection 9.

The middle part of the cap's hollow portion slidably accommodates a second shaft 13 made of a conductive material suitable for high-voltage conduction. The upper end of the conductive shaft 13 is electrically connected with the first conductive shaft 10 of the ignition coil unit 2 through a spring 12 also made of a conductive material. The lower end of the cap's hollow portion constitutes a cap chamber 1B which covers and is fixed to a terminal 14A at the top of a spark plug 14. The lower end of the second conductive shaft 13 contacts the terminal 14A of the spark plug 14. The second conductive shaft 13 thus receives high voltages for spark discharge from the secondary coil 5 of the ignition coil unit 2 through the first conductive shaft 10 and the conductive spring 12 and conducts them to the terminal 14A of the spark plug 14. The spark plug 14 is screwed firmly into the head of an internal combustion engine (not shown). The second conductive shaft 13 is enclosed by the hard resin insulator body 11 mentioned above.

In addition to the features described above, the insulator body 11 is formed with a recess 11A at its middle around the outer periphery of the body 11. The recess 11A is provided with a detective conductor 15, which is constituted of copper, aluminum or the like in the shape of a hollow tube, a half tube(s) or a split tube(s). The detective conductor 15 sandwiches a portion of the hard resin constituting the insulator body 11 between itself and the second conductive shaft 13. Thus, the conductor 15, the second conductive shaft 13 and the intervening insulator (dielectric) constitute a detective capacitor 16.

As illustrated, a shield 18 is provided around the detective conductor 15 sandwiching an insulator 17*a* therebetween. The shield 18 is fabricated from screen, net, foil or thin sheet of a good conductor material such as copper or aluminum and is disposed to be concentric with the conductor 15, and so at a fixed distance therefrom. A second insulator 17*b* covers the shield 18 and a third insulator 19 fills the rest of the recessed portion so as to form a continuous smooth exterior surface. A conductor such as a cable 23 is connected with the detective conductor 15 and extending upwardly in the insulator body 11. The cable 23 is also shielded which will be referred to below.

Figure 3:
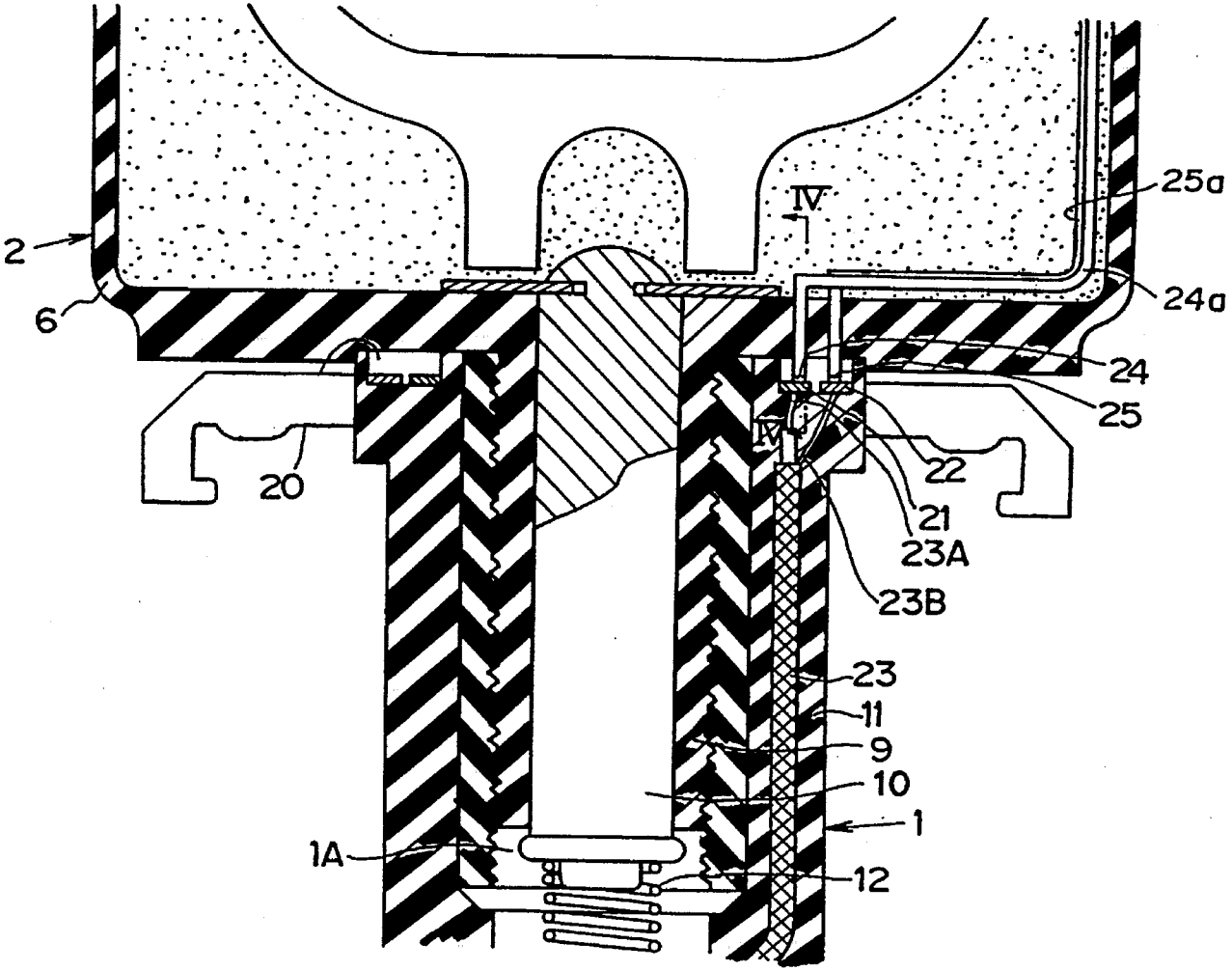
FIG. 3 is a view enlarging a portion of FIG. 1.
Figure 4:
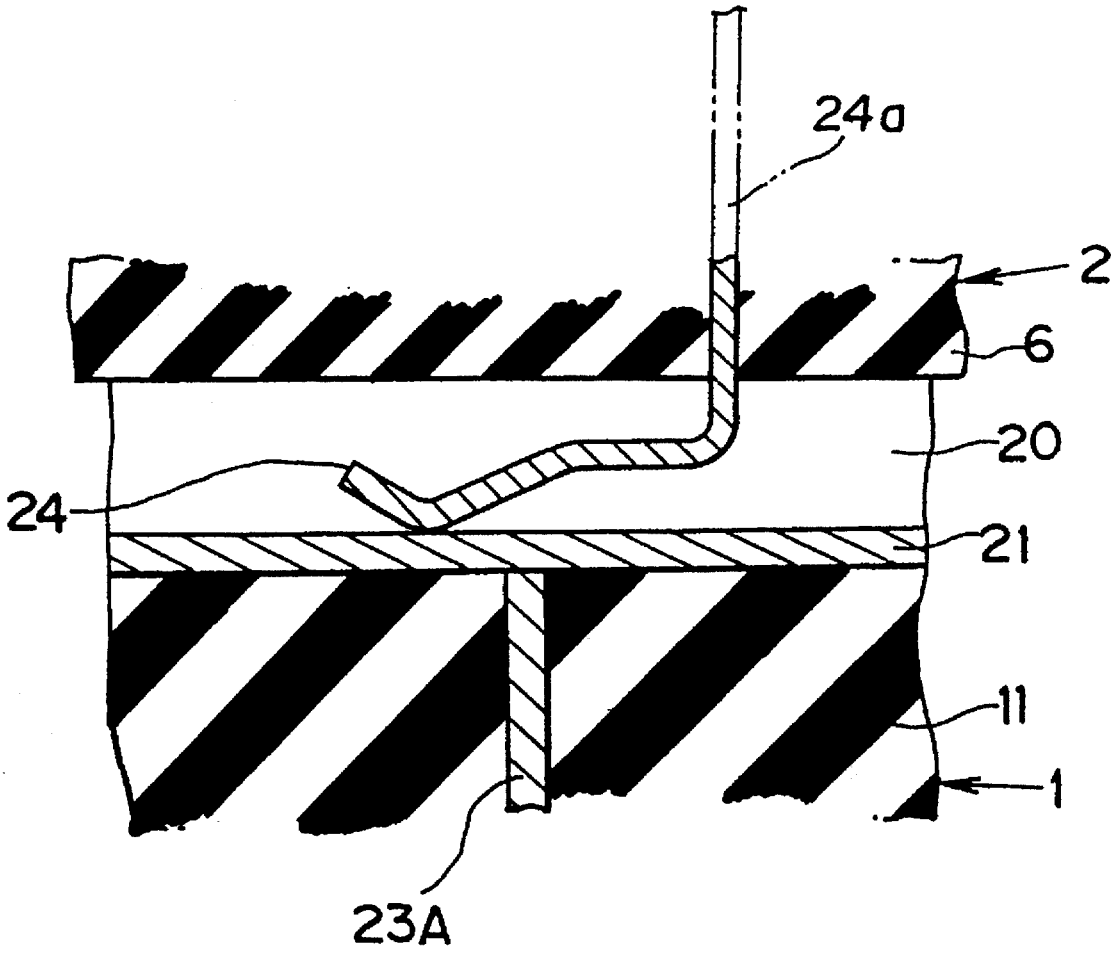
FIG. 4 is a cross sectional view taken along the line IV—IV of FIG. 3.

As clearly shown in FIGS. 3 and 4, the top end of the insulator body 11 is provided with an annular groove 20. In the annular groove 20, there are placed a first annular conductor 21 functioning as an electric contact for the detective voltage, and a second annular conductor 22, having a greater diameter than that of the first annular conductor 21 functioning as an electric contact for the ground voltage. The first and second annular conductors 21,22 are arrayed concentrically with respect to the longitudinal axis of the spark plug cap 1 maintaining a predetermined distance from each other. The first annular conductor 21 is electrically connected with the aforesaid detective conductor 15 via a conductive core 23A of the cable 23, while the second annular conductor 22 is electrically connected with the shield 18 via a shield member 23B provided in the cable 23.

Furthermore the case 6 of the ignition coil unit 2 is provided with a first contact 24 and a second contact 25 both made of a conductive metal material having elasticity sufficient for functioning as a leaf spring. The first and second contacts are configured approximately in the shape of "w" character as best shown in FIG. 4 (only the first contact 24 is illustrated there). The first and second contacts 24, 25 project downwardly from the case 6 such that they are brought into slidable contact with the first and second annular conductor 21, 22 respectively, when the case 6 is assembled with the spark plug cap 1. The first and second contacts 24, 25 are, at the opposite ends, configured as leads 24*a*, 25*a* which extend upwardly in parallel with each other in the case 6 and are guided to the terminal section 8. More specifically, as shown in FIG. 1, the leads 24*a*, 25*a* are connected to respectively connected to terminal 8*c* and 8*d* which are arranged in parallel with the aforesaid terminal 8*a*, 8*b* of the ignition coil.

With this arrangement, when an ignition current flows through the conductive shaft 13, a voltage induced at the detective conductor 15 constituting the detective capacitor with the conductive shaft 13 is transmitted to the first annular conductor 21 through the conductive core 23A of the cable 23 embedded in the insulator body 11. Since the first contact 24 is electrically connected to the first annular conductor 21 when assembled, the detected voltage is sent to the section 8 and to the terminal 8*c* via the first contact 24 and the lead 24*a* extending integrally therefrom, and finally to the signal processing circuit via a cable (not shown) connected to the terminal 8A. On the other hand, the ground voltage is applied from the terminal 8*d* at the terminal section 8 to the shield 18, via the lead 25*a* and the second contact 25 extending integrally therefrom, the second annular conductor 22 and the shield member 23*b* of the cable 23.

When assembling the spark plug cap 1 and the ignition coil unit 2, the ignition unit case's cylindrical projection 9 of the ignition coil unit 2 is placed in the cap's upper insertion section 1A and threaded into place by rotating the ignition coil unit case 6. Since the cap's contact portions 21, 22 are disposed in the form of annuli and the ignition coil unit case's contact portions 24, 25 are in the form of leaf springs, they are always brought into contact with each other irrespective of the position or angle at which the ignition coil unit case 6 has been threaded in to the section 1A at the end.

Figure 5:
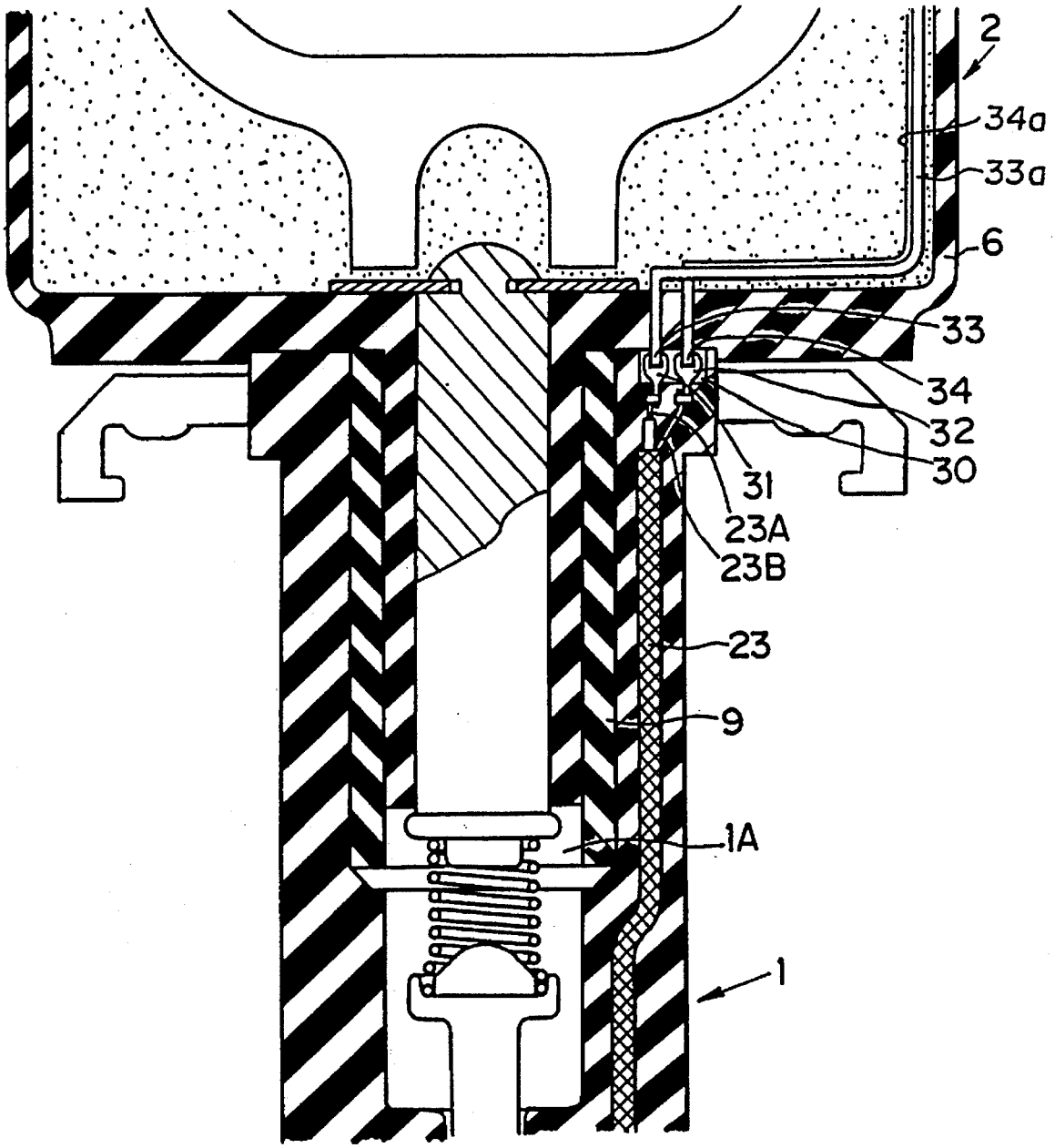
FIG. 5 is a view, similar to FIG. 3, but showing a spark plug cap according to a second embodiment of the invention.
Figure 6:
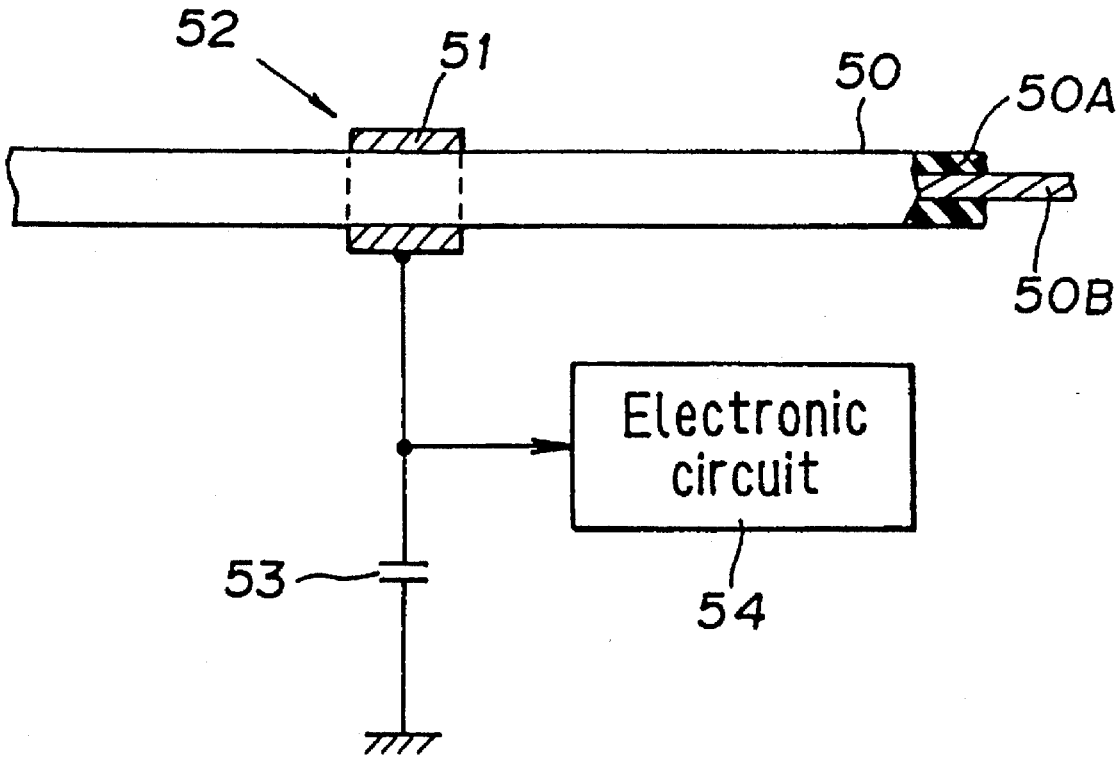
FIG. 6 PRIOR ART
FIG. 6 is a schematic view showing a prior art misfire detector.

FIG. 5 shows a second embodiment of the invention. The same references as used in the first embodiment are also used in the second embodiment so that explanations thereof are omitted.

Explaining the second embodiment by putting an emphasis on how it differs from the first embodiment, the cylindrical projection 9 of the ignition coil unit case 6 is not threaded in, but merely inserted in the upper insertion section 1A (also unthreaded) of the spark plug cap 1, and is secured there by force-fitting under application of heat or by bonding with a bonding agent.

More specifically, instead of the annular groove used in the first embodiment, the top end of the spark plug cap 1 is provided with a recess 30 and in the recess, a first connector 31 and a second connector 32 are placed side-by-side. The first and second connector 31, 32 are provided in the shape of couplers and are connected respectively with the detective conductor 15 and the shield 18 via the conductive core 23A and shield member 23B of the cable 23 in the same manner as in the first embodiment. The ignition coil unit case 6 is provided at its bottom with a first contact 33 and a second contact 34 which project downwardly therefrom to be inserted in the first and second connectors 31, 32 respectively when assembled. The first and second contacts 33, 34 are electrically connected with the terminals 8*c*, 8*d* at the terminal section 8 via leads 33*a*, 34*a* extending integrally therefrom, as in the first embodiment.

In the second embodiment, during assembly, it suffices if the ignition coil unit case's cylindrical projection 9 is inserted into the cap's upper insertion section 1A while the contacts 33, 34 are inserted to the mated connectors 31, 32, thereby ensuring electrical contact therebetween.

In the first and second embodiments, although the shield 18 is disposed around the detective conductor 15, it is alternatively possible to omit the shield 18. In that case, the second annular conductor 22 or the second connector 32 and the second contacts 25, 34 with leads 25*a*, 34*a* are omitted.

It should further be noted that the configuration of the contacting members are not limited to those disclosed, and it suffices if, when the ignition coil unit case and the spark plug cap are assembled together, any electrical connections are ensured therebetween. For example, either or both of the annular conductors 21,22 are not necessary to be a complete circle.

It should furthermore be noted that although the leads 24*a*, 25*a*, 33*a*, 34*a* are used, it is alternatively possible to use other conductors such as cable or wires for transmitting the electrical signals between the conductor and shield to the terminal 8*c* and 8*d* at the terminal section 8.

The present invention has thus been shown and described with reference to the specific embodiments. However, it should be noted that the present invention is in no way limited to the details of the described arrangements; changes and modifications may be made without departing from the scope of the appended claims.

What is claimed is:

1. A spark plug cap covering the terminal of a spark plug for an internal combustion engine, including;

an insulative cap body;

a case for housing an ignition coil to be attached to the insulative cap body and having a terminal for the ignition coil;

a first conductor housed in the insulative cap body for carrying an ignition voltage produced by the ignition coil to the spark plug terminal; and a second conductor located around the first conductor keeping a predetermined distance therefrom while sandwiching an insulative material therebetween such that a capacitor is formed between the first and second conductors for detecting the ignition voltage;

wherein the improvement comprises;

a first contact provided at the end of said insulative cap body and electrically connected with said second conductor; and a second contact electrically connected with the terminal of said case such that the second contact is brought into contact with the first contact when said case is attached to said insulative cap body.

2. A spark plug cap according to claim 1, wherein said case is attached to the insulative cap body through threading.

3. A spark plug cap according to claim 2, wherein said first contact is in the shape of an annulus centering on the longitudinal axis of the spark plug cap.

4. A spark plug cap according to claim 3, wherein said second contact is configured as a leaf spring.

5. A spark plug cap according to claim 1, wherein said first contact is electrically connected with said second conductor through a third conductor embedded in the insulative cap body.

6. A spark plug cap according to claim 5, wherein said third conductor is provided with a shield.

7. A spark plug cap according to claim 5, wherein said third conductor is shielded.

8. A spark plug cap according to claim 1, wherein said case is attached to the insulative cap body through insertion.

9. A spark plug cap according to claim 8, wherein said first contact is configured as a connector for receiving said second contact.

10. A spark plug cap covering the terminal of a spark plug for an internal combustion engine, including;

an insulative cap body;

a case for housing an ignition coil to be attached to the insulative cap body and having a terminal for the ignition coil;

a first conductor housed in the insulative cap body for carrying an ignition voltage produced by the ignition coil to the spark plug terminal;

a second conductor located around the first conductor keeping a predetermined distance therefrom while sandwiching an insulative material therebetween such that a capacitor is formed between the first and second conductors for detecting the ignition voltage; and a shield for shielding the second conductor;

wherein the improvement comprises;

a first pair of contacts provided at the end of said insulative cap body, one of which being electrically connected with said second conductor while the other being connected to the shield; and a second pair of contacts electrically connected with the terminal of said case such that the second pair of contacts are brought into contact with the first pair of contacts respectively when said case is attached to said insulative cap body.

11. A spark plug cap according to claim 10, wherein said case has a projection formed with screw threading on its outer surface and said insulative cap body has a threaded recess formed as a female screw to be mated with threading formed as the projection and said case is attached to the insulative cap body by threading the projection into the recess.

12. A spark plug cap according to claim 11, wherein said first pair of contacts are in the shape of an annulus centering on the longitudinal axis of the spark plug cap.

13. A spark plug cap according to claim 12, wherein said second pair of contacts are configured as leaf springs.

14. A spark plug cap according to claim 10, wherein said one of the first pair of contacts is electrically connected with said second conductor through a third conductor embedded in the insulative cap body.

15. A spark plug cap according to claim 14, wherein said other of the first pair of contacts is electrically connected with a member which shields the their conductor.

16. A spark plug cap according to claim 10, wherein said case has a projection and said spark plug cap has a recess and said case is attached to the insulative cap body by inserting the projection into the recess.

17. A spark plug cap according to claim 16, wherein said first pair of contacts are configured as connectors for receiving said second pair of contacts respectively.

* * * * *

UNITED STATES PATENT AND TRADEMARK OFFICE

CERTIFICATE OF CORRECTION

PATENT NO. : 5,487,676

DATED : January 31, 1997

INVENTOR(S) : MARUYAMA et al.

It is certified that error appears in the above-indentified patent and that said Letters Patent is hereby corrected as shown below:

Column [8], line 67 please delete "their" insert therefor --third--.

Signed and Sealed this

Twentieth Day of May, 1997

Bruce Lehman

BRUCE LEHMAN

*Commissioner of Patents and Trademarks*

*Attest:*

*Attesting Officer*